US005608377A

United States Patent [19]

Zhevlev et al.

[11] Patent Number: 5,608,377

[45] Date of Patent: Mar. 4, 1997

[54] ACOUSTIC ANTI-TAMPERING DETECTOR

[75] Inventors: Boris Zhevlev, Rishon le Zion; Mark Moldavsky, Tel Aviv, both of Israel

[73] Assignee: Visonic Ltd., Tel Aviv, Israel

[21] Appl. No.: 546,037

[22] Filed: Oct. 20, 1995

[51] Int. Cl.[6] ..... G08B 29/00

[52] U.S. Cl. ..... 340/506; 340/565; 340/566; 340/429; 340/690; 367/197

[58] Field of Search ..... 340/506, 565, 340/566, 429, 683, 690; 367/197, 198, 199

[56] References Cited

U.S. PATENT DOCUMENTS

| | | | |
|---|---|---|---|
| 3,863,230 | 1/1975 | McCluskey | 340/274 |
| 3,889,250 | 6/1975 | Soloman | 340/274 |
| 4,091,660 | 3/1978 | Yanagi | 73/658 |
| 4,134,109 | 1/1979 | McCormick | 340/550 |
| 4,271,491 | 6/1981 | Simpson | 367/136 |
| 4,383,250 | 6/1983 | Galvin | 340/521 |
| 4,386,343 | 5/1983 | Shiveley | 340/566 |
| 4,668,941 | 5/1987 | Davenport | 340/550 |
| 4,743,886 | 5/1988 | Steiner et al. | 340/514 |
| 4,745,398 | 5/1988 | Abel | 340/500 |
| 4,837,558 | 6/1989 | Abel | 340/550 |
| 4,853,677 | 8/1989 | Yarborough | 340/544 |
| 4,882,567 | 11/1989 | Johnson | 340/522 |
| 5,117,220 | 5/1992 | Marino | 350/550 |
| 5,164,703 | 11/1992 | Rickman | 340/515 |
| 5,192,931 | 3/1993 | Smith | 340/550 |

FOREIGN PATENT DOCUMENTS 0233390 8/1987 European Pat. Off. .

*Primary Examiner*—Jeffery Hofsass
*Assistant Examiner*—Daryl C. Pope
*Attorney, Agent, or Firm*—Ladas & Parry

[57] ABSTRACT

A method of supervising the operation of an intrusion detector having a housing, the method including periodically generating in the housing at least one sound wave signal, sensing an acoustic image formed in the housing in response to the at least one sound wave signal, constructing a sensed signal envelope responsive to the sensed acoustic image, periodically comparing the sensed signal envelope with a reference signal envelope to determine whether a predetermined criterion of similarity between the sensed signal envelope and the reference signal envelope is met and, if the similarity criterion is not met, providing a predetermined, sensible, indication.

20 Claims, 10 Drawing Sheets

TAIL CONDITION COMPUTATION AND TEST

ACOUSTIC ANTI-TAMPERING DETECTOR

FIELD OF THE INVENTION

This invention relates to intrusion detectors in general and, more specifically, to acoustic analysis detectors which detect the sound of breaking glass.

BACKGROUND OF THE INVENTION

A wide array of intrusion detectors are known in the art. Some of these detect the presence of an intruder in a particular area and others detect intrusions into the area, or attempts to break into the area. One type of intrusion detector for determining break-in is a glass breakage detector.

One type of glass breakage detector analyzes sounds picked up by a microphone to determine if they are produced by breaking glass. A foolproof determination of glass breakage by acoustic means is extremely complicated since many factors must be taken into account in order to avoid both false alarms, when there is no break-in, and undetected events of true glass breakage.

U.S. Pat. No. 3,863,250 to McClusky, Jr. describes a glass breakage detector which is directly mounted on a sheet of glass whose breakage is to be detected. The detector comprises a sensor mounted on layers of material which attenuate acoustic frequencies which are not characteristic of the shock of breaking glass.

U.S. Pat. No. 4,134,109 to McCormick et al. comprises a signal analysis circuit which utilizes a sound having an intensity above a given threshold level to start the detection process. The system waits a predetermined interval and then determines if the integrated signal at a majority of a plurality of frequencies characteristic of falling glass is above a threshold during a pre-set time window starting after the interval. If the threshold condition is met and the sound at these frequencies ceases by a pre-set time, an alarm is sounded.

U.S. Pat. No. 4,668,941 to Davenport et al. describes a glass breakage detection system that utilizes the frequency components of the thump of glass breakage at about 350 Hz and the tinkle of breaking glass caused by collision of glass fragments at about 6.5 kHz. A very low frequency signal triggers a time delay of about 200 milliseconds and establishes a time window which closes at 800 milliseconds or one second. An alarm is sounded if there is a high frequency signal greater than a threshold value during the time window. In order to avoid false alarms such as may be caused by tapping on the window, a particular frequency to voltage convertor is used to exclude all frequencies below 4.5 kHz.

U.S. Pat. No. 4,837,558 to Abel et al. describes a tuned unidirectional glass breakage detector responsive to sounds in the 4 to 8 kHz range.

U.S. Pat. No. 4,853,677 to Yarbrough et al. describes a glass breakage detector which detects sounds at 3 kHz to 4 kHz to determine if there has been glass breakage. The detector also includes a door or window opening detector which detects pressure changes at 1–2 Hz. The sensitivity of the glass breakage detector is increased in the presence of low frequency signals since the combination is said by the patent to indicate a break-in wherein steps have been taken to minimize breaking glass sounds.

None of the above prior art devices is sufficiently effective in determining glass breakage for certain types of glass such as safety or laminated glass. Furthermore, the analysis of sounds provided by these devices is not capable of determining glass breakage for a variety of glass types while also having a low false alarm rate.

There are also known methods of supervising the operation of an audio intrusion detection system. For example, there are methods for detecting attempts to inconspicuously tamper with the audio detection system. U.S. Pat. No. 5,164,703 describes a supervisory circuit which periodically generates a test sound into the space monitored by the audio detection system. The detection system detects reflections of the test sound in the monitored space and generates a corresponding test signal. Using a comparator, the test signal is compared with a predetermined threshold and the operability of the detection system is determined based on the comparison results. The intrusion detection mode of the system is inoperative during the supervisory time periods. It is noted that the threshold used by the comparator of the supervisory circuit is constant.

SUMMARY OF THE INVENTION

The present invention seeks to provide a device and a method for supervising the operation of an intrusion detector, such as a glass breakage-detector, particularly for detecting attempts to obscure the detector or to otherwise tamper therewith.

A preferred embodiment of the present invention is particularly suitable for detecting attempts to tamper with a housing of the intrusion detector, for example by shutting openings in the housing of the detector.

The device of the present invention preferably includes a sound wave generator, in the housing of the detector, which generates a predetermined sequence of sounds or a swept frequency sound. A microphone senses the acoustic response of the housing to the generated sequence of sounds, or swept frequency, and provides a corresponding response signal. It has been found by the present inventors that the acoustic response of the housing to sounds produced therein is very sensitive to changes in attributes of the housing, such as changes in openings of the housing and/or changes in objects associated with the housing.

The response signal, which is preferably digitized, is compared by a microprocessor to a predetermined reference signal, using predetermined comparison criteria. If the response signal is sufficiently "different" from the reference signal, a potential tampering attempt is detected. When a tampering attempt is detected, the detector activates a predetermined sensible indication, such as a buzzer. The anti-tampering detection procedure of the present invention is preferably carried out periodically during very short time periods.

In principle, the method of the present invention includes the following:

- periodically generating in a housing of the detector at least one sound wave signal;
- sensing an acoustic image formed in the housing in response to the at least one sound wave signal;
- constructing a sensed signal envelope responsive to the sensed acoustic image;
- periodically comparing the sensed signal envelope with a reference signal envelope to determine whether a predetermined criterion of similarity between the sensed signal envelope and the reference signal envelope is met; and
- if the similarity criterion is not met, providing a predetermined, sensible, indication.

Additionally, in a preferred embodiment of the present invention, the method includes replacing the reference signal envelope with the sensed signal envelope, if the similarity criterion is met.

In a preferred embodiment of the invention, the at least one sound wave signal includes a sequence of sound wave signals each having a different frequency. Alternatively, the at least one sound wave signal includes a swept frequency sound.

In a preferred embodiment of the present invention, periodically comparing the sensed signal envelope with the reference signal envelope includes comparing the envelopes a predetermined number of times before determining whether the similarity criterion is met.

According to one preferred embodiment of the invention, periodically comparing the sensed signal envelope with the reference signal envelope includes periodically comparing the integral of the sensed signal envelope over a predetermined frequency range with the integral of the reference signal envelope over the predetermined frequency range. Alternatively, in a preferred embodiment, periodically comparing the sensed signal envelope with the reference signal envelope includes periodically comparing the amplitude of the sensed signal at predetermined frequencies with the amplitude of the reference signal envelope at the predetermined frequencies.

In a preferred embodiment of the invention, the intrusion detector includes an acoustic analysis detector, for example a glass breakage detector. However, the present invention may also be used in conjunction with any other intrusion detector known in the art.

BRIEF DESCRIPTION OF THE DRAWINGS

The invention will be more clearly understood from the following description of preferred embodiments thereof in conjunction with the following drawings in which.

DETAILED DESCRIPTION OF PREFERRED EMBODIMENTS

Figure 1A:
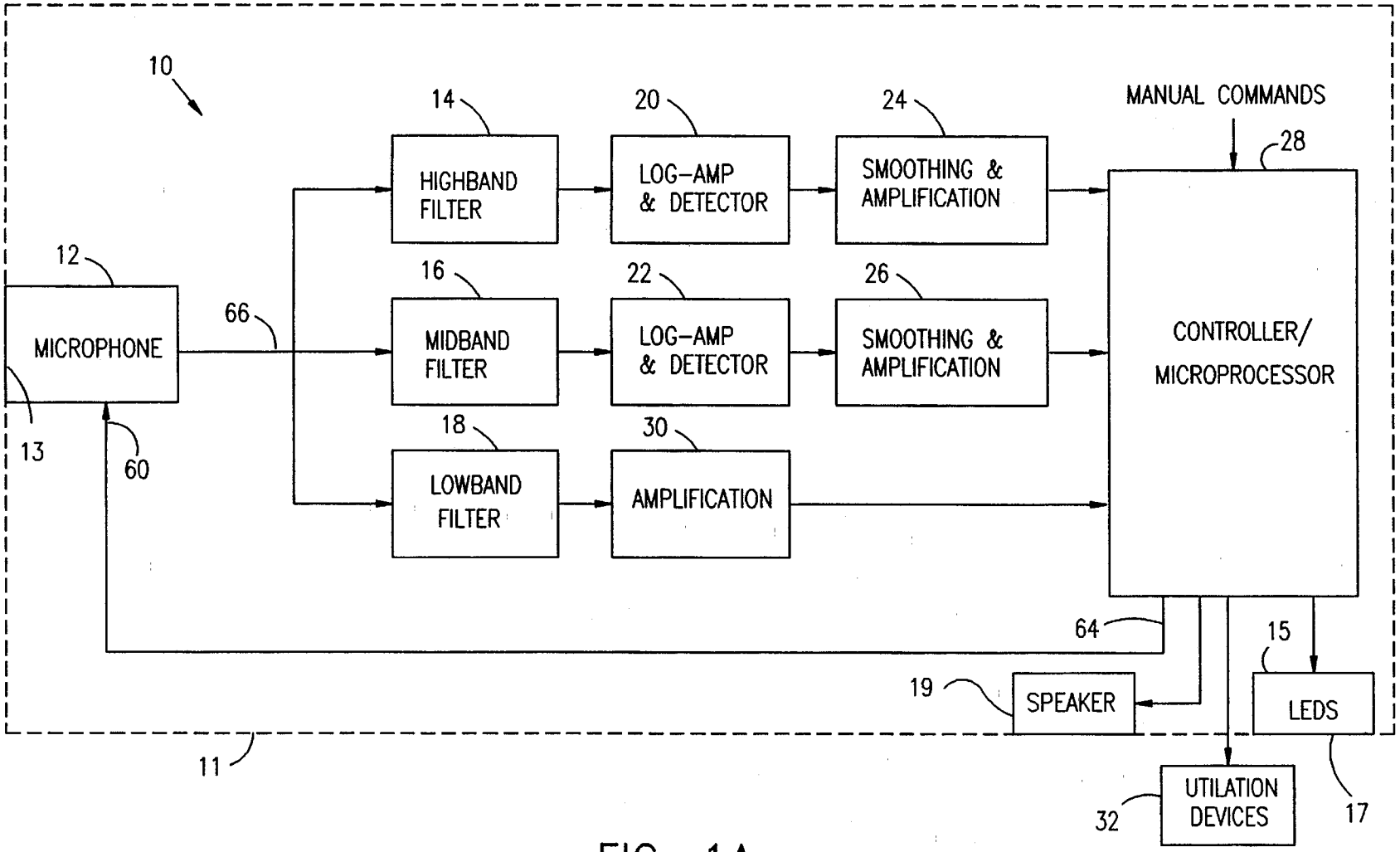
FIG. 1A is a block diagram of a glass breakage detector in accordance with a preferred embodiment of the invention.
Figure 1B:
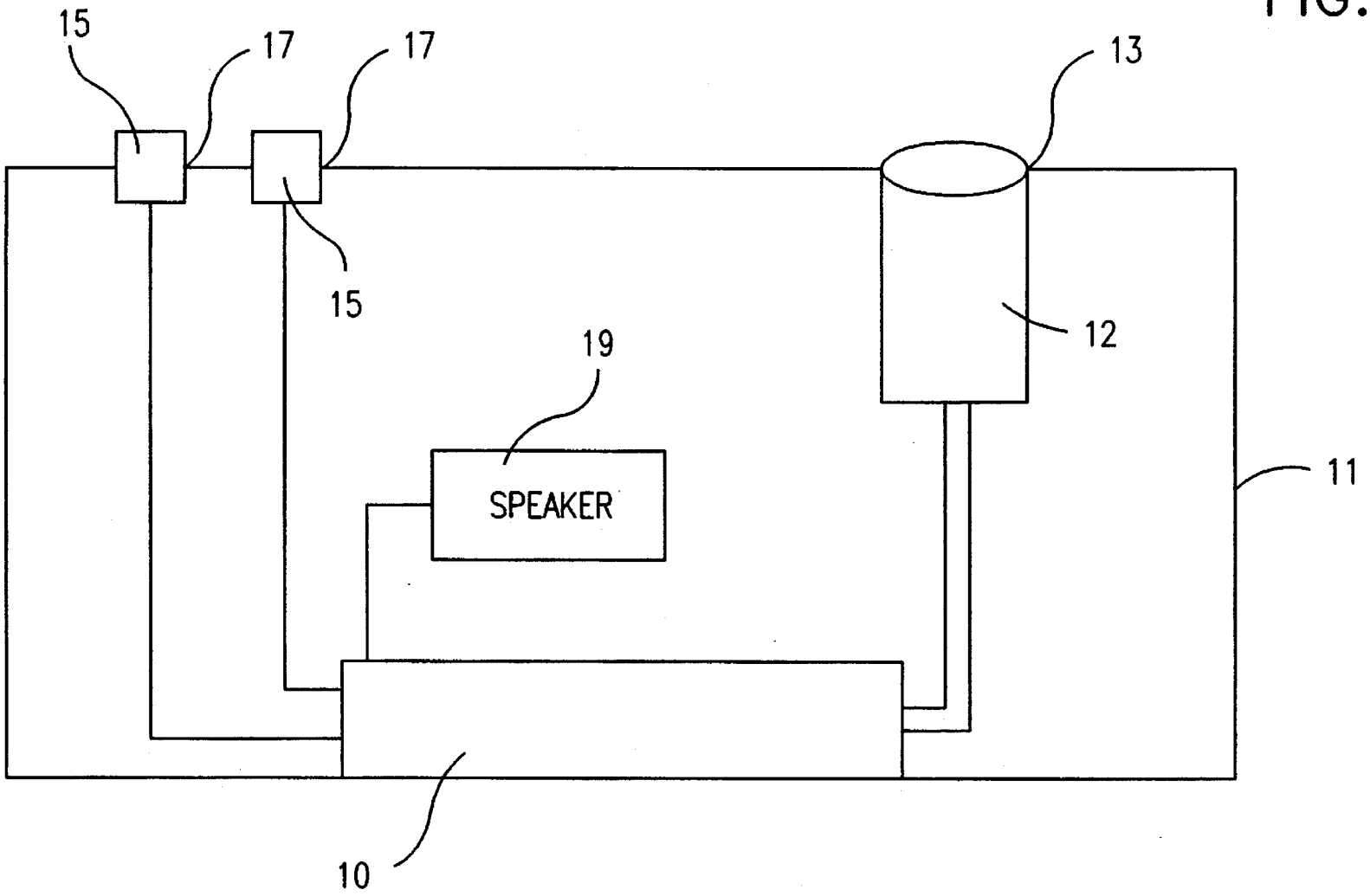
FIG. 1B is a simplified cross-sectional drawing of a glass breakage detector in accordance with a preferred embodiment of the invention.

FIG. 1A is a block diagram of a glass breakage detector 10 in accordance with a preferred embodiment of the invention. Detector 10 is preferably enclosed in a housing, shown schematically in FIG. 1A by dashed line 11 which may comprise a plastic case. Preferably, as shown in FIG. 1B, case 11 includes an opening 13 which sound can reach a microphone 12. Case 11 may also have visual signal elements 15 mounted in mounting holes 17 in the case. Microphone 12 may be, for example, a type CMP-758 microphone manufactured by Boesung, Ltd. of Korea. When sound energy reaches microphone 12, an electrical signal is generated, which is fed to a triad of filters, namely, a high-band filter 14, a mid-band filter 16 and a low-band filter 18. In a preferred embodiment of the invention, high-band filter 14 has a center frequency of about 5.2 kHz and a bandwidth of about ±1 kHz; mid-band filter 16 has a center frequency of about 250 Hz and a bandwidth of about ±50 Hz; and low-band filter 18 has a center frequency of about 40 Hz and a bandwidth of about ±25 Hz.

High-band and mid-band filtered signals which are the results of the operation of high-band and mid-band filters 14 and 16 are separately fed to a pair of log-amplifiers/detectors 20 and 22 which amplify the signals while compressing the range of the amplified signals logarithmically and then envelope detect the amplified signal. The detected signals are further smoothed and amplified by a pair of smoothing/amplification circuits 24 and 26 before being fed to respective inputs of a controller or microprocessor 28 (hereinafter referred to as microprocessor 28 for simplicity) for further processing.

A low-band filtered signal which is the result of the operation of low-band filter 18 is amplified, preferably by a linear amplifier 30, before being fed to an input of microprocessor 28. The low-band signal is preferably digitally detected and filtered by microprocessor 28.

The three signals which are fed to microprocessor 28 are preferably sampled by the microprocessor so that microprocessor 28 may more easily process and analyze the signals. In one embodiment of the invention samples are taken every 0.25 milliseconds although most computations are based on samples spaced at 4 millisecond intervals. However, higher sampling and/or computation rates are believed to be useful if the controller/microprocessor is able to handle the data generated at the higher rates.

Microprocessor 28 first digitally smooths the signals in the three bands and then analyzes the signals by the method described below and sends a signal (generally, the closing of a switch) to one or more utilization devices 32 signaling that a glass breakage has occurred. Utilization devices 32 generally include at least one control center which receives signals from a number of detectors of one or more types and which activates one or more of an alarm bell, a buzzer, a speaker fed by an alarm signal, a computer at a remote location which receives an indication of a glass breakage, a telephone line which automatically dials a remote telephone, for example, a police telephone or any other suitable indicator of glass breakage. Generally one or more LED mounted on case 11 is also activated. Microprocessor 28 also is used to activate a speaker 19 which is optionally present in the case during a test mode described below.

Detection apparatus 10 preferably compares a number of characteristics of one or more signals to predetermined criteria to determining if a glass breakage event has occurred. Some of the criteria involve characteristics of signals in all three frequency bands, some involve characteristics of signals in two bands and some involve only one band.

One type of criteria is used to reject sound patterns which are never associated with breaking glass. A second type is used to verify that the sound pattern is indeed a glass breakage effect and that no additional testing or analysis is required.

Some criteria comprise two ranges of values. If the signal characteristic meets a "tight" range, i.e., the signal characteristics are within a narrow range of values, the event is immediately identified as a glass breakage event. If the signal characteristics are within a wider range of values, the analysis continues to the next step. If the signal characteristics are outside the wider range, the event is identified as a non-breakage event and is ignored and no further processing is performed.

Figure 2:
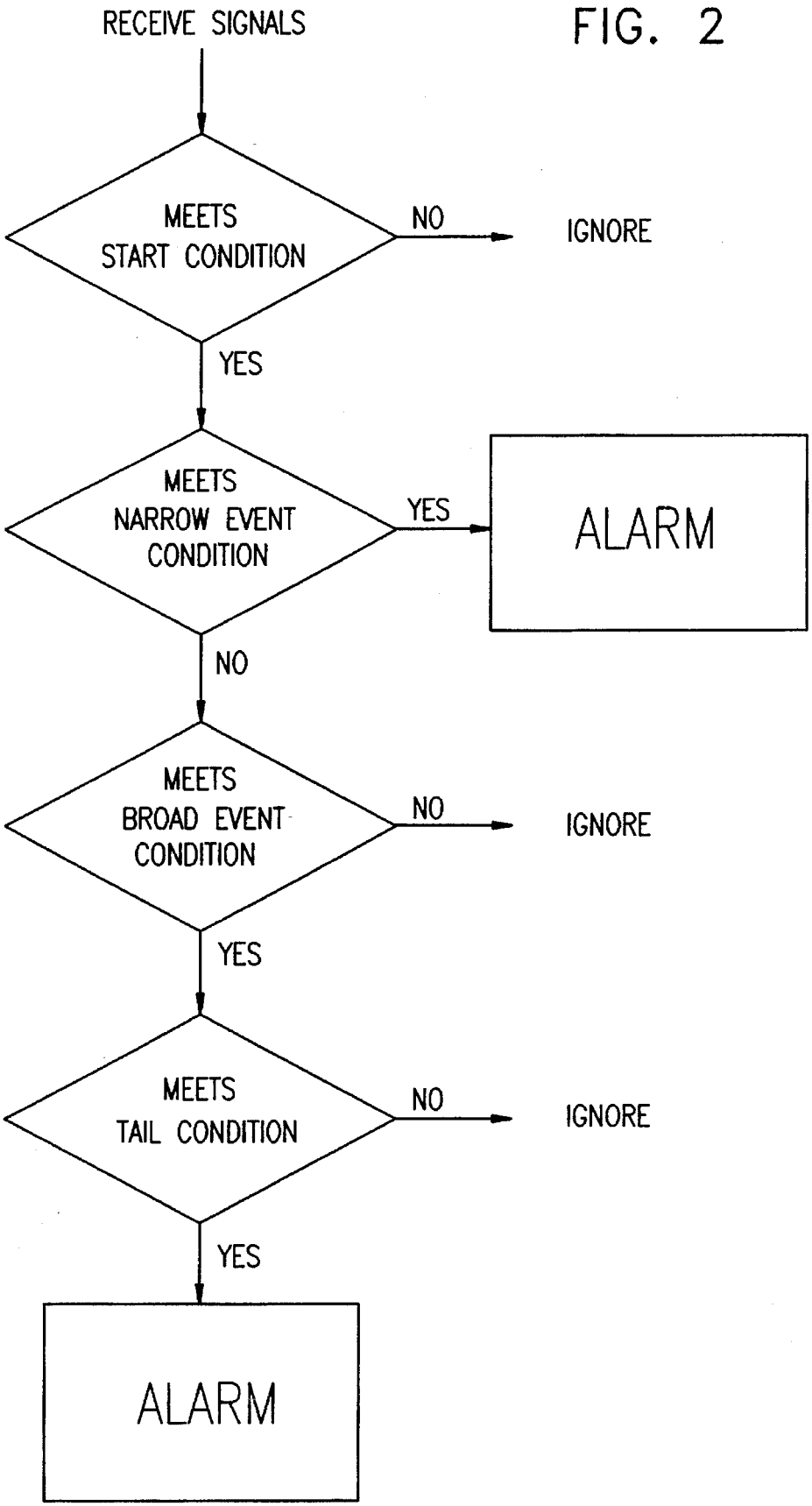
FIG. 2 is a flow chart of the process of determining if glass breakage has occurred according to a preferred embodiment of the invention.

Reference is made to FIG. 2 which shows a general overview of a preferred method of signal analysis of the present invention in flow diagram form.

The first step in the process is the determination whether an event which has occurred is potentially a glass breakage event. In order to make this determination microprocessor 28 continuously computes the value of the normalized rate of rise of the signals in each of the three band signals and compares the computed value to a preset threshold. This comparison is given by the formula:

$$(dv/dt) \div v \geqq 125 \quad (1)$$

for each of the three bands. In formula (1) dv/dt is the rate of change of the signal and v is the signal value at the time the rate of change is measured. In addition, the signals must have a predetermined minimum value so that noise does not activate the system.

In practice the rate of rise requirement translates (for a 4 millisecond time between samples) into the requirement that:

$$(\delta v/v) \geqq 0.5 \quad (2)$$

where $\delta v$ is the change in signal voltage between two successive samples.

The three signals need not meet the rate of rise (start of sequence) requirement simultaneously. The start requirement is considered met if the signals in all the bands meet the requirement within a 32 millisecond interval. This interval is used since it is one half the period of the low-band center frequency.

In a preferred embodiment of the invention, events for which the rate of rise criteria is met first by the low frequency signal is rejected as a non-glass breakage event. This situation is not characteristic of glass breakage, but rather of other events, such as a slamming door.

The next step in the process is to determine if the signals meet narrow and/or broad event criteria for a glass-breakage event. If the event meets the narrow event criteria, then the event is immediately identified as a glass breakage event and an alarm is sounded. If the signals fail to meet any of the broad event criteria, the event is ignored. If they meet the broad event criteria, microcomputer 28 checks if a tail criteria is met. If it is, the alarm is sounded; if not, the event is ignored.

The above-mentioned narrow and broad conditions are described in detail with reference to FIGS. 3A and 3B.

Figure 3A:
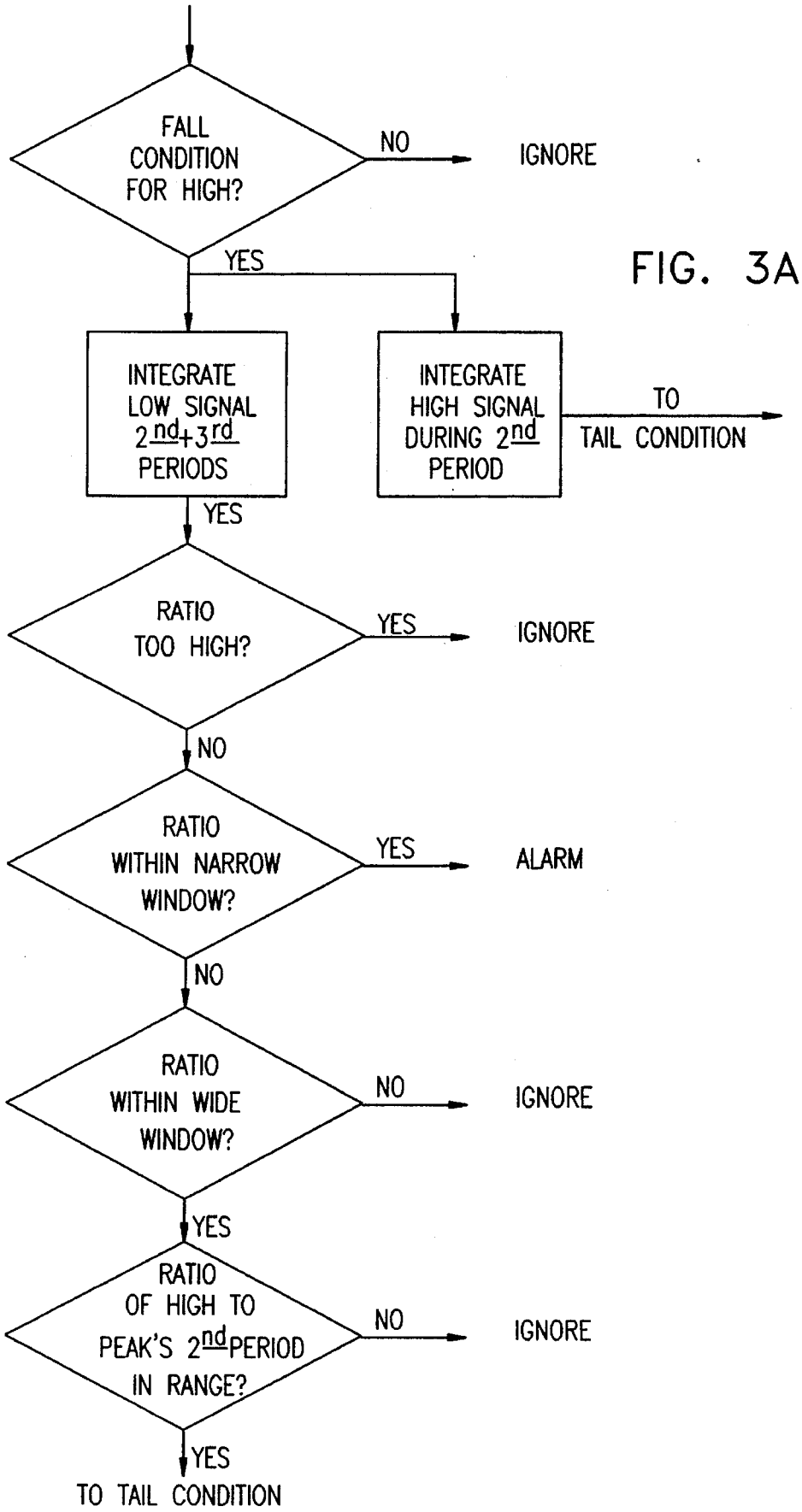
FIG. 3A and 3B are more detailed flow charts of portions of the chart of FIG. 2.
Figure 3B:
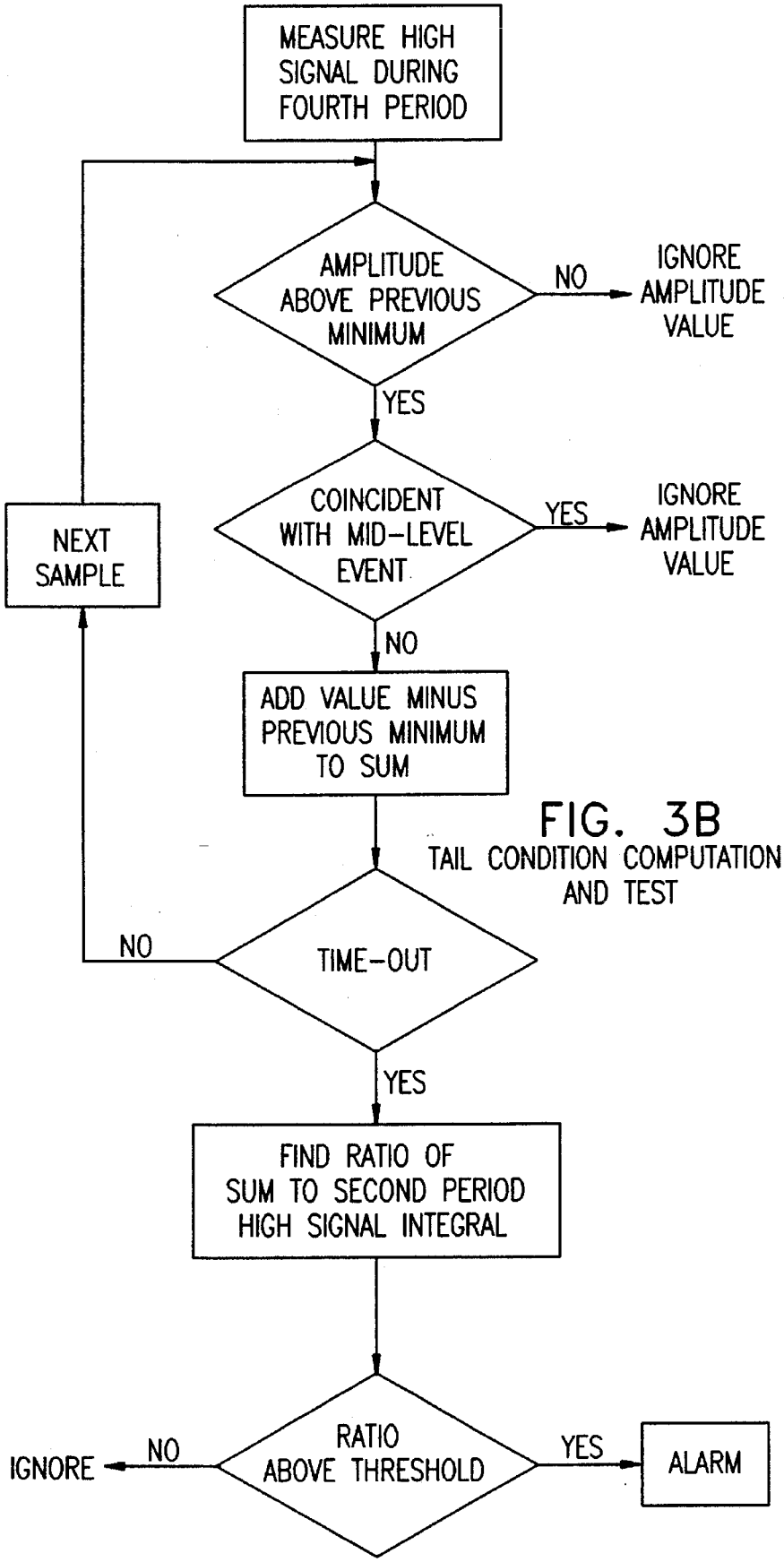

Reference is first made to FIG. 3A which shows the preferred methodology used to determine if the signals meet the various narrow and broad conditions.

In the preferred method of the invention, the time frame of the event is divided into a number of periods, starting at the fulfillment of the "start" condition (which is considered herein to comprise a first period). The next two periods are each preferably 128 milliseconds long. The fourth period starts 256 milliseconds after the start condition and ends 1024 milliseconds later. These periods have been found to work well, however, some variation of these periods is possible.

During the second period, the high and mid-band signals rise to a peak and begin to fall. If the signals fall too quickly, the event is immediately recognized as a non-breakage event and is ignored. While the rate of fall can be measured in a number of ways, the preferred method is to measure the ratio between the peak of the signal and its value at the end of the second period. In a preferred embodiment of the invention, signals which have a ratio of less than 4 are rejected although values as low as 2 can be used as exclusion ratios. A fall criteria may be required of both the high and mid band signals; however, it is generally sufficient for the high-band signal alone to meet the criteria.

During the second period, the high-band and low-band signals are preferably integrated and the result is stored. During the third period, the low-band signal is integrated and the result is compared with the low-band signal integral from the second period. If the integral from the third period is higher than that from the second period, this signifies that the glass has not broken but is vibrating. Thus, if the ratio of the third to second period integrals is greater than 1, the event is ignored.

Furthermore, if the ratio is less than 0.25, the event is also not a breakage event, but may be a hand-clap or other event. In this situation, the event is also ignored. If the ratio is between 0.25 and 1.0, the signal is further processed.

In practice the integrals are computed by simply summing the sampled values of the respective signals during the respective time period.

The amplitudes of the peak high-band and mid-band signals (which occur during the second period) are preferably compared. While the ratio of the two signals is dependent on the circuitry used, for the preferred embodiment of the invention shown in FIGS. 5A–5E, this ratio is required to be between 0.25 and 4.

If an event has meet the above criteria, i.e., it has been neither rejected or immediately accepted as a glass-breakage event, a tail condition criteria is applied to the signals to make a final determination.

In order to determine if the tail condition criteria has been met, the integral of the high-band signal during the fourth period is computed and compared with the integral of the high band signal during the second period. In order to meet the tail condition criteria, the integral in the fourth period must be above a given percentage of the integral in the second period.

The integral in the fourth period is computed in a different way from that in the second period. In essence, the method used in the fourth period integration attempts to isolate sounds caused by individual falling glass pieces or groups of pieces from other sounds which may be present. This is done in two ways.

Figure 4:
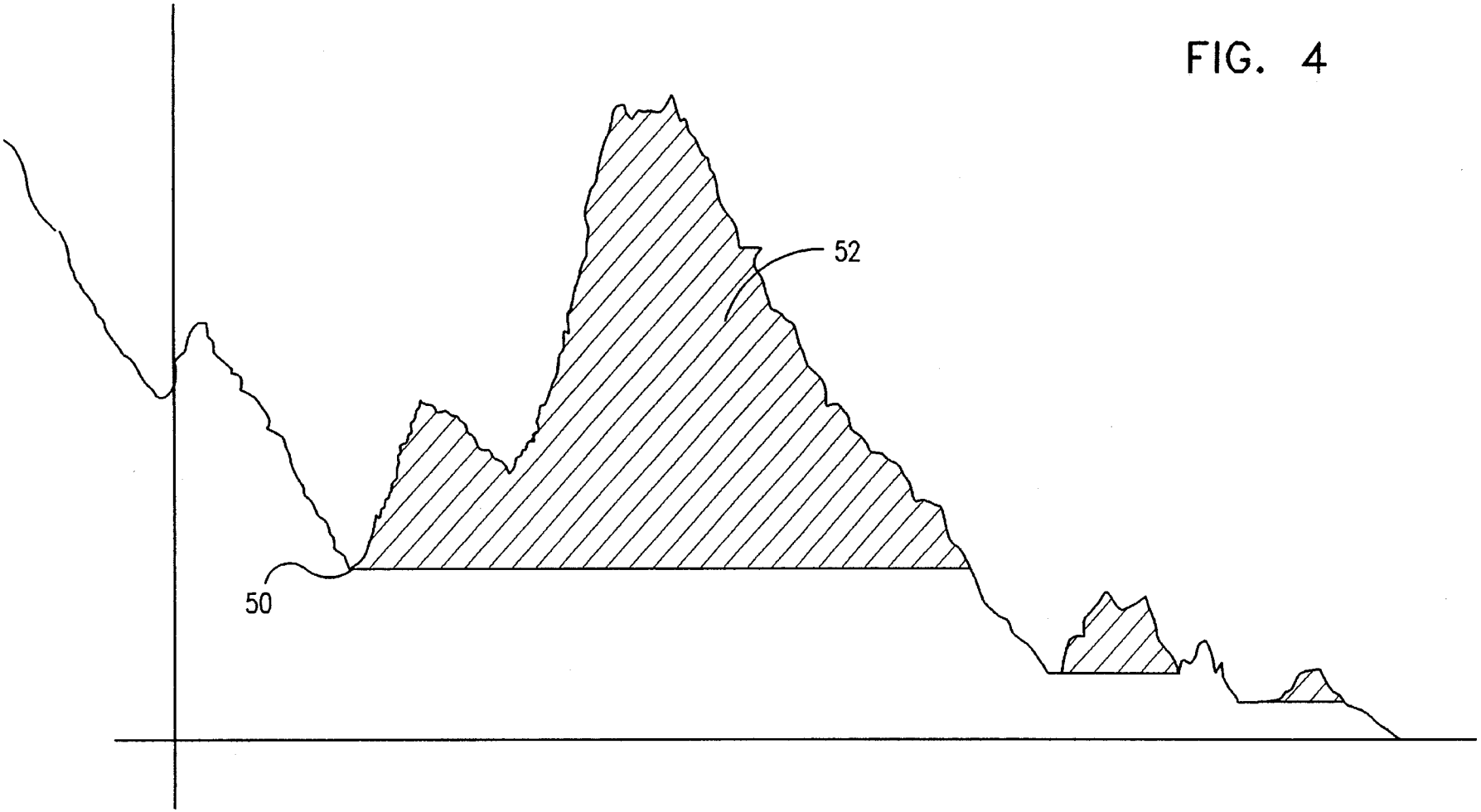
FIG. 4 shows a detail of the calculation of a tail signal integral.

First, the integral is taken only of those portions of the high-band signal which are above a threshold which is set by the previous minimum of the signal. This is best understood with reference to FIG. 4, which shows a portion of the high-band signal during the fourth period. The threshold level is set at a first minimum value 50 and during a following period the integral is taken of the value of the signal minus the threshold value. The integration continues so long as the signal is above the value at 50. In essence this means that the integral is adjusted by subtracting the minimum value (at 50) times the integration time from it.

When the signal falls below threshold value 50 the signal is ignored so long as it continues to fall. When the signal reaches a new minimum and rises again, the new minimum becomes the threshold value for additional integration. In practice the integral is taken only of the area of the signal which is marked by reference number 52.

Second, high-band signals which occur at the same time as mid-band signals are not included in the integral. In practice coincidence between the two signals is measured using the same rate of rise criteria as is used for the start condition, except that the coincidence time is reduced to 8 milliseconds. This time could be shortened if the sampling time were faster, since measurement shows that an actual coincidence time of only about 2 milliseconds is adequate to reject coincident signals. If the coincidence condition is met, the integral is not included until the next relative minimum is reached.

While a number of criteria have been described, it is possible to use only some of these criteria and in some embodiments of the invention it may be desirable to use fewer criteria.

FIGS. 5A–5E show actual circuitry used in a preferred embodiment of the invention. All of the amplifiers are preferably one-quarter of LM324 quad op-amps.

Figure 5A:
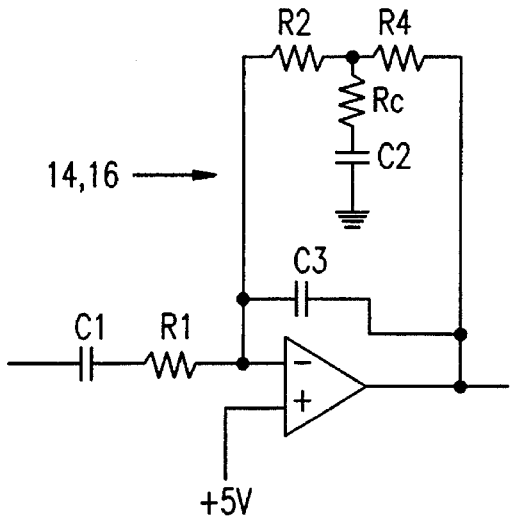
FIGS. 5A–5E show the electronic circuitry utilized in a preferred embodiment of the present invention.

FIG. 5A shows a preferred implementation of the high-band and mid-band filters 14 and 16. For the high-band filter, C1=100 pf, C2=47 nf, R1=1.5MΩ, R2=R4=100KΩ, R3=150Ω and C3 is omitted. For the mid-band filter, C1=100 pf, C2=47 nf, C3=15 pf; R1=1.5MΩ, R2=R4=750KΩ, R3=1KΩ.

Figure 5B:
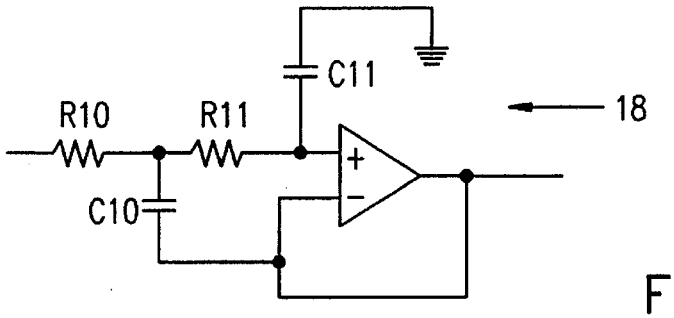

FIG. 5B shows a preferred implementation of low-band filter 18 where R10=R11=82KΩ, C10=C11=47 nf.

Figure 5C:
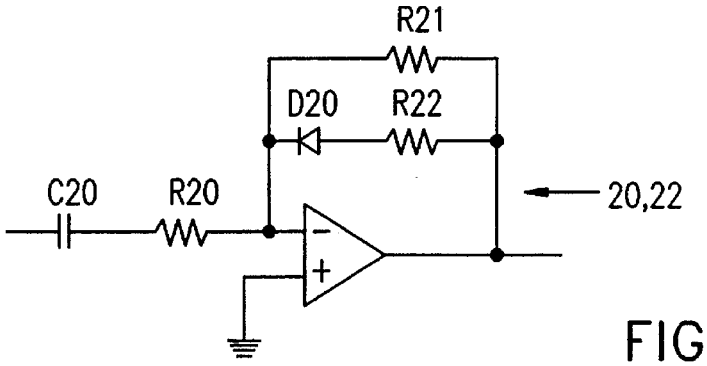

FIG. 5C shows a preferred implementation of log amplifiers/detectors 20 and 22 (which are identical) where C20=47 nf, R20=4.7KΩ, R21=150KΩ, R22=27KΩ and D20 is a 1N4148 diode.

Figure 5D:
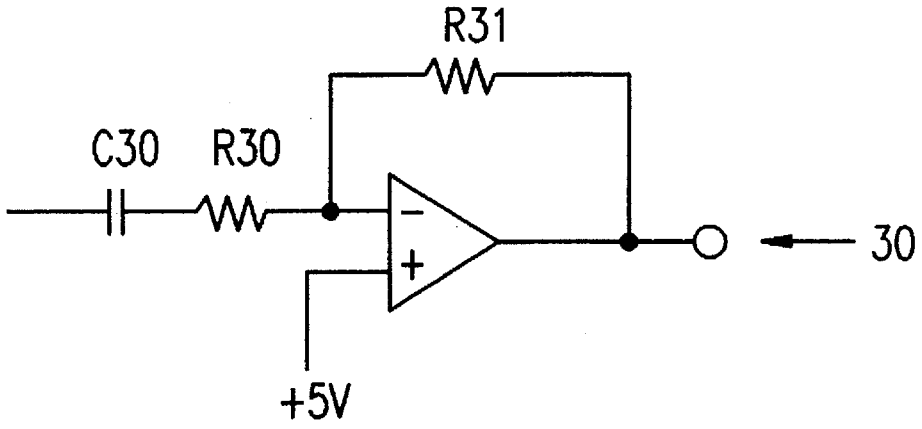

FIG. 5D shows a preferred implementation of amplifier 30 where C30=47 nf, R30=39KΩ, R31=3.3MΩ.

Figure 5E:
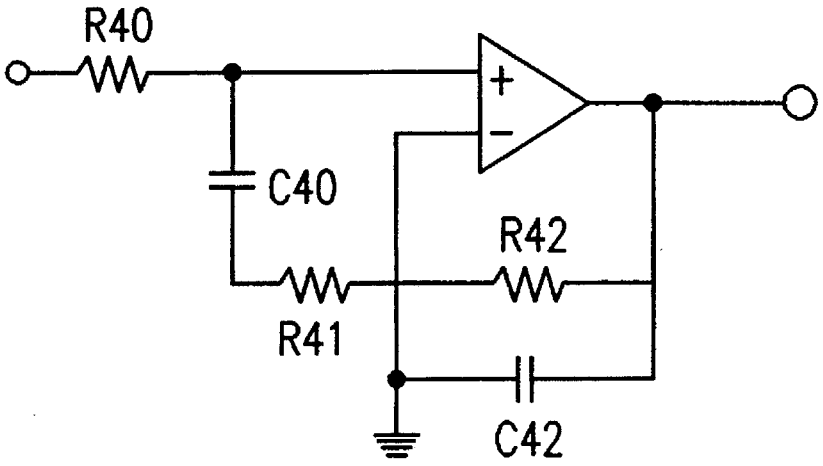

FIG. 5E shows a preferred implementation of smoothing/amplification circuits 24 and 26 (which are identical) where R40=R41=20KΩ, C40=C41=22 nf, R42=1MΩ.

In a practical implementation of the invention, controller/microprocessor 28 is a PIC16C71 microcontroller. It may, however, be advantageous to use a more powerful microprocessor in some implementations of the invention.

In a preferred embodiment of the invention, the operation of the circuitry of detector 10 may be tested using speaker 19. Referring to FIGS. 1A and 1B, microprocessor 28 instructs speaker 19 to emit a swept frequency sound or a sequence of single frequency sounds. These sounds, which may be of a low level, are detected by microphone 12 and processed by the electronic circuitry of blocks 20–26 before being fed to microprocessor 28.

The sound frequencies emitted by speaker 19 are preferably distributed within a distinct frequency range, preferably a high frequency range. A swept frequency from 4 KHz to 6 KHz, centered at approximately 5.3 KHz, has been found suitable for the purposes of the present invention, when used in conjunction with the glass-breakage detector described above. This is because controller/microprocessor 28 is adapted to analyze this high frequency range for glass-breakage detection, as described above. It should be appreciate, however, that any other frequency range may be suitable if appropriate sound producing means and hardware or software are provided.

Microprocessor 28 checks the level of the received signals against the commands sent to speaker 19 and, based on these values, determines whether the microphone, amplifiers and filters are operating correctly. By producing additional signals, at a second sound level, the log-amplification can also be tested.

If the detector determines that one or more portions of the circuitry is inoperative, either a warning light is flashed or an indication is sent to the control center or a remote watch station. A buzzer in the detector may be activated as a further indication.

In an alternative, preferred, embodiment of the invention, the circuitry shown in FIG. 1A is used to feed the swept or sequential signals to the detection circuitry via the microphone. In this embodiment, one terminal 60 of microphone 12 is connected to an output 64 of microprocessor 28 and another terminal 66 of microphone 12 is connected to the high, mid and low-band filters. In normal operation, output 64 is grounded and the detector operates in the normal manner described above. In a self-test mode, the swept or sequential signals are fed to terminal 60 of microphone 12 and pass through the microphone, with a known attenuation, to the other terminal. The amplitude of the signals fed to microprocessor 28 via the electronics contained in the blocks of FIG. 1 is measured by microprocessor 28 to determine if the electronics is operating properly.

In a further preferred embodiment of the invention, microprocessor 28 executes a tampering-detection procedure including a query on whether the detector has been disabled, for example by covering opening 13 of case 11. This condition can be distinguished by examining the sound levels and/or frequency distribution detected by the microphone in response to the sequence of sound signals or the swept frequency emitted by speaker 19. The sound levels and/or frequency distribution detected in case 11 will be hereinafter referred to as the sound image. In accordance with a preferred embodiment of the invention, a sound image substantially different from a reference sound image indicates that the cover has been tampered with, for example by covering openings such as opening 13, in an attempt to disable the detector.

Figure 7:
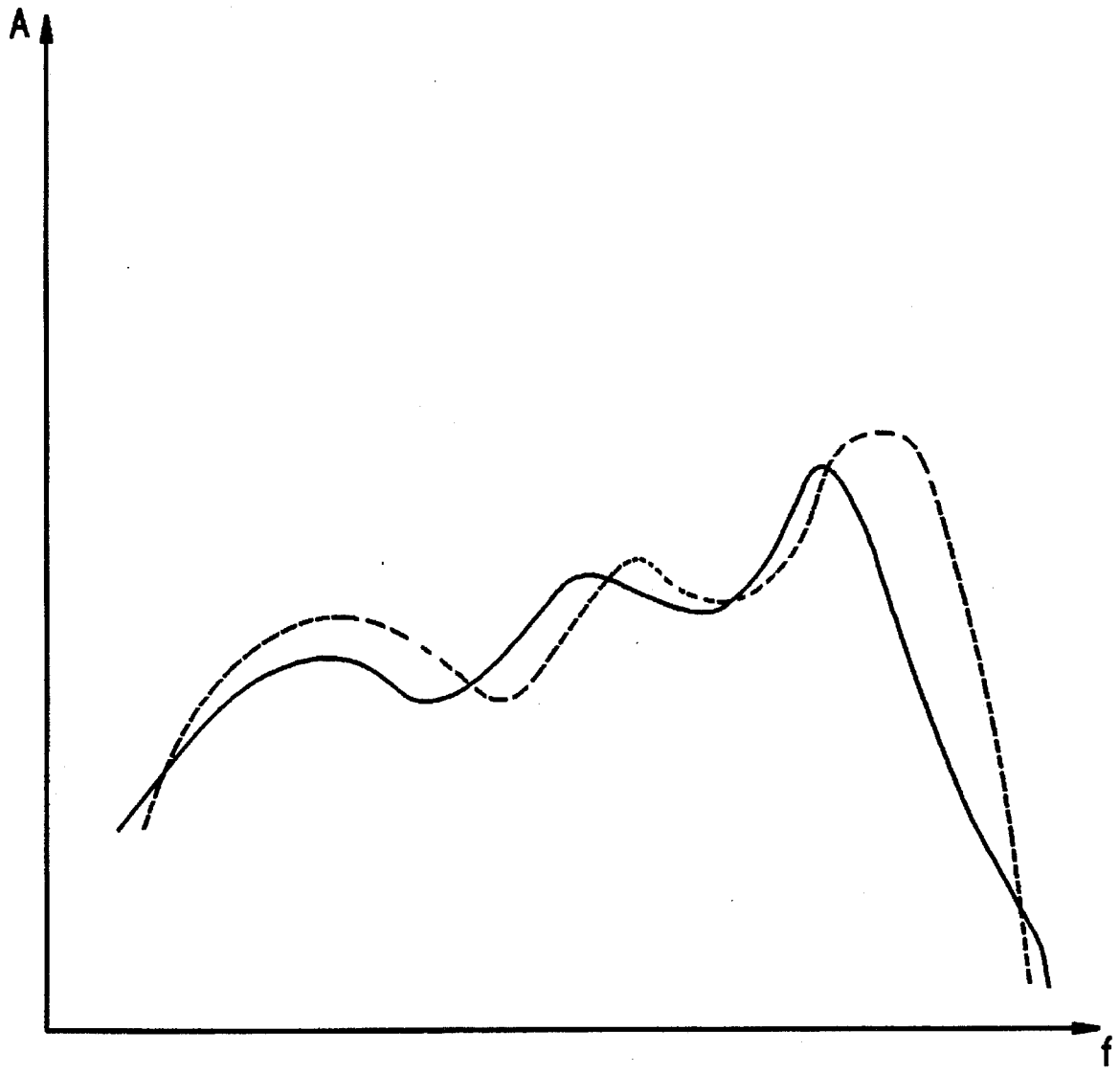
FIG. 7 is a schematic illustration of graphs representing a detected sound image compared to a reference sound image, in accordance with a preferred embodiment of the present invention.

FIG. 7 schematically illustrates a detected sound image (broken line) superimposed with a reference sound image (solid line). The sound images are represented by graphs of signal amplitude (A) as a function of signal frequency (f).

In a preferred embodiment of the invention, the detected sound image is transformed, by the electronics of blocks 14–30, into an envelope of electric signals which correspond to the detected sound image. The envelope is preferably stored temporarily in a memory of microprocessor 28. The detected envelope is then compared with a reference envelope, in the memory of microprocessor 28, to determine whether predetermined similarity criteria are met. The similarity criteria may include, inter alia, a comparison of the integrals of the envelopes and/or extremums of the envelopes and/or envelope forms. An appropriate threshold for determining similarity or dissimilarity is preferably set in accordance with the type of comparison performed, e.g., a threshold difference between the integrals of the envelopes over a predetermined frequency range or a threshold of the sum of absolute value differences between the envelopes at predetermined frequencies. For example, if the emitted test signal is a swept frequency and similarity is determined based on the integral of the envelope over a predetermined frequency range, the threshold may be defined as a predetermined ratio between the integrals of the detected and reference envelopes. Preferably, in this example, the envelopes are considered similar if the ration between them is within a predetermined range, for example between 0.75 and 1.25.

If the detected envelope is similar to the reference envelope, according to the standard set by the similarity criterion used, it is assumed that the intrusion detector has not been tampered with. However, changes in environmental conditions and system noise cause slight differences between the envelopes. To account for these changes, which do not amount to a dissimilarity, the reference envelope is preferably replaced by the detected envelope for future reference. This provides a "floating" reference envelope which is updated periodically after each tampering-detection procedure in which the envelopes are found similar. It should be appreciated that the use of floating thresholds enables use of more strict similarity criteria and, thus, provides a higher detection sensitivity.

If the detected envelope is not similar to the reference envelope, according to the standard set by the similarity criterion used, it is assumed that the intrusion detector has been tampered with and a sensible indication is activated using any of the methods described above. It is appreciated that if the similarity criteria and thresholds are selected and applied properly, the detection sensitivity should be sufficient for detecting any attempt to tamper with the intrusion detector, for example, by closing openings such as opening 13, by creating new openings in case 11 or by attaching a sound suppressing material to the case.

Figure 6:
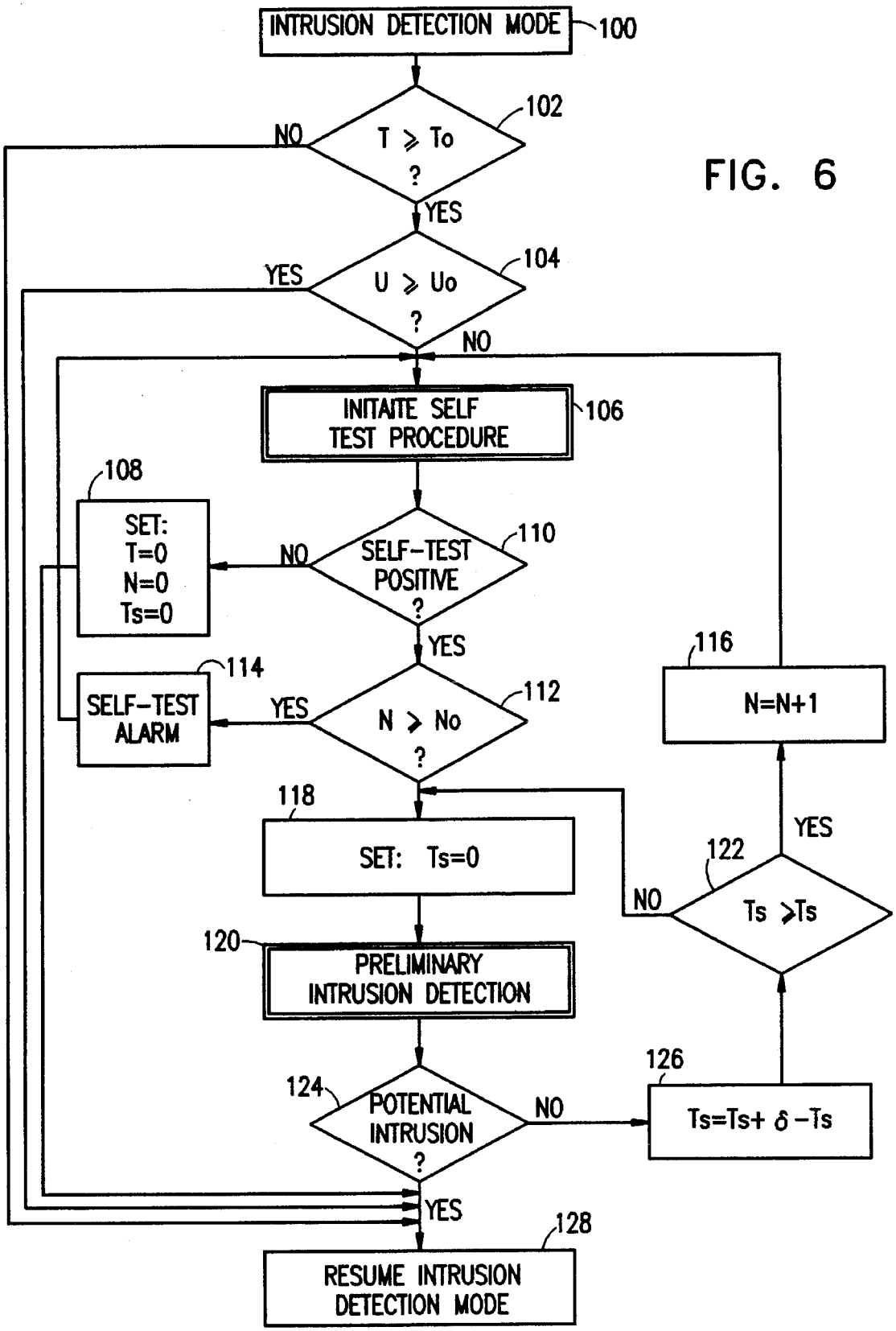
FIG. 6 is a schematic flow chart illustrating a method of operation of a glass breakage detector having an anti-masking detection mode, in accordance with a preferred embodiment of the present invention.

Reference is now made to FIG. 6 which schematically illustrates a preferred method of operation of a glass breakage-detector incorporating a tampering-detection procedure as described above. The method of FIG. 6 and the tampering-detection procedure incorporated therein are preferably both executed by appropriate software or dedicated hardware, for example, in microprocessor 28. In a preferred embodiment of the invention, microprocessor 28 is periodically briefly switched to a tampering-detection mode, e.g. for a period of approximately 30 milliseconds every 15 minutes, while the remaining processing time of microprocessor 28 is dedicated to glass-breakage detection, as indicated at blocks 100 and 128. It should be appreciated that time periods on the order of 30 milliseconds are generally not significant in detection of glass breakage events and, thus, the tampering-detection mode is not expected to affect the credibility of the glass-breakage detector. Nevertheless, as described below, the tampering-detection mode is preferably not activated when glass-breakage is suspected and/or when relatively high ambient noise levels are detected.

A timer and a thresholder are preferably used to control the times for activation of the tampering-detection mode of microprocessor 28. As indicated at block 102, the timer measures a lapsed time, T, which is compared to a threshold time $T_0$. Once time $T_0$ is reached, the noise level, U, in the detected signal is compared to a predetermined threshold level, $U_0$, and if $U \geqq U_0$, as indicated at block 104, the tampering-detection procedure is terminated and the intrusion detection mode is resumed at block 128. If $U<U_0$, microprocessor 28 proceeds to execute the tampering-detection procedure described above, the duration of which is on the order of 30 milliseconds, as indicated at block 106. In a preferred embodiment of the present invention , $U_0$ is a predetermined fraction of a maximum signal level, $U_{max}$, used by microprocessor 28, for example $\frac{1}{4}U_{max}$. The tampering-detection results are then checked, as indicated at block 110. As described below, a counter maintains a count of the number of tampering detections, N.

If the tampering-detection results are negative, i.e. no tampering attempt is detected, time T and number N are reset, as indicated at block 108, and the intrusion detection mode is resumed at block 128. An alarm start time, Ts, which is measured by an additional timer as described below, is also reset when the tampering-detection results are negative.

If the tampering-detection results are positive, i.e. a tampering attempt has been detected, the tampering-detection number, N, is compared to a threshold tampering-detection number, $N_0$, as indicated at block 112. It should be noted that threshold number $N_0$ determines the number of tampering detections required by the system for detecting a genuine tampering attempt. $N_0$ is preferably selected in accordance with system attributes, such as noise, and external conditions, such as the acoustic characteristics in the vicinity of the detector.

If $N \geqq N_0$, a sensible indication such as an alarm is activated for a predetermined period of time, for example three seconds, as indicated at block 114, and the tampering-detection procedure is reactivated at block 106. If $N<N_0$, a preliminary intrusion detection procedure is activated, as indicated at block 120, whereby the detected signals are subjected to a preliminary, coarse, glass-breakage detection analysis. Preferably, the preliminary intrusion detection procedure includes potential glass-breakage detection as described above with reference to the top block of FIG. 2. In fact, the preliminary intrusion detection procedure may be performed by the hardware and software used for that purpose in the glass-breakage detection mode. It should be appreciated that the preliminary intrusion detection procedure prevents activation of the tampering-detection mode during a glass-breakage event and, thus enabling continuous glass-breakage supervision.

If the preliminary analysis indicates a potential glass-breakage event, the intrusion detection mode is resumed at block 128. If the preliminary analysis indicates no potential glass-breakage event, alarm start time Ts is increased by a predetermined time step, $\delta Ts$, for example 1 second, as indicated at block 126. As long as Ts is under threshold $Ts_0$, which is preferably between 5 and 10 seconds, for example 6 seconds, the preliminary analysis procedure is repeated at block 120. However, when Ts is greater than or equal to $Ts_0$, the tampering-detection number, N, is raised by one and the tampering-detection procedure is reactivated at block 106.

The present invention has been thus far described in conjunction with an acoustic analysis detector. In this preferred application of the invention, the acoustic analysis circuitry used for intrusion detection is also used, in a different mode, for detecting tampering attempts. It should be appreciated, however, that the present invention may also be applied to other types of intrusion detectors, for example to passive infrared detectors. When the present invention is applied to non-acoustic detectors, the acoustic analysis circuitry is preferably adapted particularly for the tampering-detection mode.

The present invention has been described above in a context of a dedicated hardware system. However, it should be appreciated that at least some aspects of the present invention may be executed by computer software, as is well known in the art.

It will be appreciated by persons skilled in the art that the present invention is not limited by what has been particularly shown and described herein. Rather, the scope of the present invention is defined only by the claims which follow:

We claim:

1. A method of supervising the operation of an intrusion detector having a housing, the intrusion detector being operative to determine the presence of an intrusion outside the housing, the method comprising:

periodically generating in the housing at least one sound wave signal;

sensing an acoustic image formed in the housing of the intrusion detector in response to said at least one sound wave signal;

constructing a sensed signal envelope responsive to said sensed acoustic image;

periodically comparing the sensed signal envelope with a reference signal envelope to determine whether a predetermined criterion of similarity between the sensed signal envelope and the reference signal envelope is met; and if the similarity criterion is not met, providing a predetermined, sensible, indication.

2. A method according to claim 1 wherein the at least one sound wave signal comprises a sequence of sound wave signals each having a different frequency.

3. A method according to claim 1 wherein the at least one sound wave signal comprises a swept frequency sound.

4. A method according to claim 1 wherein periodically comparing the sensed signal envelope with the reference signal envelope comprises comparing said envelopes a predetermined number of times before determining whether the similarity criterion is met.

5. A method according to claims 2 wherein periodically comparing the sensed signal envelope with the reference signal envelope comprises comparing said envelopes a predetermined number of times before determining whether the similarity criterion is met.

6. A method according to claim 3 wherein periodically comparing the sensed signal envelope with the reference signal envelope comprises comparing said envelopes a predetermined number of times before determining whether the similarity criterion is met.

7. A method according to claim 4 wherein periodically comparing the sensed signal envelope with the reference signal envelope comprises comparing said envelopes a predetermined number of times before determining whether the similarity criterion is met.

8. A method according to claim 1 wherein periodically comparing the sensed signal envelope with the reference signal envelope comprises periodically comparing the integral of the sensed signal envelope over a predetermined frequency range with the integral of the reference signal envelope over the predetermined frequency range.

9. A method according to claim 2 wherein periodically comparing the sensed signal envelope with the reference signal envelope comprises periodically comparing the integral of the sensed signal envelope over a predetermined frequency range with the integral of the reference signal envelope over the predetermined frequency range.

10. A method according to claim 3 wherein periodically comparing the sensed signal envelope with the reference signal envelope comprises periodically comparing the integral of the sensed signal envelope over a predetermined frequency range with the integral of the reference signal envelope over the predetermined frequency range.

11. A method according to claim 4 wherein periodically comparing the sensed signal envelope with the reference signal envelope comprises periodically comparing the integral of the sensed signal envelope over a predetermined frequency range with the integral of the reference signal envelope over the predetermined frequency range.

12. A method according to claim 1 wherein periodically comparing the sensed signal envelope with the reference signal envelope comprises periodically comparing the amplitude of the sensed signal at predetermined frequencies with the amplitude of the reference signal envelope at the predetermined frequencies.

13. A method according to claim 1 wherein the intrusion detector comprises an acoustic analysis detector.

14. A method of supervising the operation of an intrusion detector having a housing, the intrusion detector being operative to determine the presence of an intrusion outside the housing, for the determination of intrusion in the region, the method comprising:

periodically generating in the housing at least one sound wave signal;

sensing an acoustic image formed in the housing of the intrusion detector in response to said at least one sound wave signal;

constructing a sensed signal envelope responsive to said sensed acoustic image;

periodically comparing the sensed signal envelope with a reference signal envelope to determine whether a predetermined criterion of similarity between the sensed signal envelope and the reference signal envelope is met;

if the similarity criterion is met, replacing the reference signal envelope with the sensed signal envelope; and if the similarity criterion is not met, providing a predetermined, sensible, indication.

15. A method according to claim 14 wherein the at least one sound wave signal comprises a sequence of sound wave signals each having a different frequency.

16. A method according to claim 14 wherein the at least one sound wave signal comprises a swept frequency sound.

17. A method according to claim 14 wherein periodically comparing the sensed signal envelope with the reference signal envelope comprises comparing said envelopes a predetermined number of times before determining whether the similarity criterion is met.

18. A method according to claim 14 wherein periodically comparing the sensed signal envelope with the reference signal envelope comprises periodically comparing the integral of the sensed signal envelope over a predetermined frequency range with the integral of the reference signal envelope over the predetermined frequency range.

19. A method according to claim 14 wherein periodically comparing the sensed signal envelope with the reference signal envelope comprises periodically comparing the amplitude of the sensed signal at predetermined frequencies with the amplitude of the reference signal envelope at the predetermined frequencies.

20. A method according to claim 14 wherein the intrusion detector comprises an acoustic analysis detector.

* * * * *